US009150227B1

(12) United States Patent
Habermehl

(10) Patent No.: US 9,150,227 B1
(45) Date of Patent: Oct. 6, 2015

(54) RECEIVE ATTENUATION SYSTEM FOR A LOCOMOTIVE CONSIST

(71) Applicants: Electro-Motive Diesel, Inc., LaGrange, IL (US); Secure Communications Systems Inc., Santa Ana, CA (US)

(72) Inventor: Neil Keith Habermehl, Irvine, CA (US)

(73) Assignees: Electro-Motive Diesel, Inc., LaGrange, IL (US); Secure Communications Systems Inc., Santa Ana, CA (US)

( * ) Notice: Subject to any disclaimer, the term of this patent is extended or adjusted under 35 U.S.C. 154(b) by 0 days.

(21) Appl. No.: 14/246,782

(22) Filed: Apr. 7, 2014

(51) Int. Cl.

| | |
|---|---|
| ***G06F 7/00*** | (2006.01) |
| ***G06F 17/00*** | (2006.01) |
| ***B61L 15/00*** | (2006.01) |
| ***B61L 25/04*** | (2006.01) |
| ***B61L 25/02*** | (2006.01) |

(52) U.S. Cl.
CPC ..... *B61L 15/0072* (2013.01); *B61L 15/0027* (2013.01); *B61L 15/0036* (2013.01); *B61L 25/026* (2013.01); *B61L 25/04* (2013.01)

(58) Field of Classification Search
CPC ..... H03G 3/20; H04B 3/60
USPC ..... 701/19, 20, 24; 375/257; 455/136, 138, 455/232.1–254; 340/13.37
See application file for complete search history.

(56) References Cited

U.S. PATENT DOCUMENTS

| | | | | |
|---|---|---|---|---|
| 3,610,920 | A * | 10/1971 | Frielinghaus | 246/128 |
| 5,588,005 | A * | 12/1996 | Ali et al. | 370/346 |
| 5,969,643 | A * | 10/1999 | Curtis | 340/988 |
| 6,281,606 | B1 * | 8/2001 | Westlake | 307/125 |
| 6,445,732 | B1 * | 9/2002 | Beamish et al. | 375/224 |
| 6,490,523 | B2 * | 12/2002 | Doner | 701/482 |
| 7,254,421 | B2 * | 8/2007 | Archiable | 455/574 |
| 8,494,695 | B2 * | 7/2013 | Cooper et al. | 701/19 |
| 2005/0076716 | A1 * | 4/2005 | Turner | 73/579 |
| 2010/0168941 | A1 * | 7/2010 | Geiger et al. | 701/20 |
| 2010/0241295 | A1 * | 9/2010 | Cooper et al. | 701/19 |
| 2012/0070013 | A1 * | 3/2012 | Vau | 381/71.4 |
| 2012/0163201 | A1 * | 6/2012 | Williams et al. | 370/252 |
| 2013/0112815 | A1 * | 5/2013 | Tokumaru | 246/124 |
| 2013/0248659 | A1 * | 9/2013 | Lingvall et al. | 246/126 |

FOREIGN PATENT DOCUMENTS

| | | |
|---|---|---|
| EP | 2 178 064 | 4/2010 |

* cited by examiner

*Primary Examiner* — Khoi Tran
*Assistant Examiner* — Jorge Peche
(74) *Attorney, Agent, or Firm* — Finnegan, Henderson, Farabow, Garrett & Dunner LLP

(57) ABSTRACT

A receive attenuation system for a locomotive consist having a communication network is disclosed. The system may have a trainline communication processor and an adjustable attenuator. The adjustable attenuator may be configured to be connected to the network and variably attenuate a signal received via the network before transmitting the signal to the trainline communication processor. The system may also have a gain controller coupled to the adjustable attenuator. The gain controller may be configured to identify a transmitting locomotive from which the signal was sent, determine a tuned attenuation control value based on a distance between the transmitting locomotive and a receiving locomotive, and control the adjustable attenuator according to the tuned attenuation control value.

20 Claims, 4 Drawing Sheets

RECEIVE ATTENUATION SYSTEM FOR A LOCOMOTIVE CONSIST

TECHNICAL FIELD

The present disclosure relates generally to a receive attenuation system, and more particularly, to a receive attenuation system for a locomotive consist.

BACKGROUND

A consist includes one or more locomotives that are coupled together to produce motive power for a train of rail vehicles. The locomotives each include one or more engines, which combust fuel to produce mechanical power. The engine (s) of each locomotive can be supplied with liquid fuel (e.g., diesel fuel) from an onboard tank, gaseous fuel (e.g., natural gas) from a tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, the consist can be positioned at the front, middle, or end of the train. In some instances, more than one consist can be included within a single train. In some consists, the locomotives include computer systems for maintaining operations of the locomotive.

Because the locomotives of a consist must cooperate to propel the train, communication between the locomotives can be important. Historically, this communication has been facilitated through the use of an MU (Multi-Unit) cable that extends along the length of the consist. An MU cable is comprised of many different wires, each capable of carrying a discrete signal used to regulate a different aspect of consist operation. For example, a lead locomotive generates current within a particular one of the wires to indicate a power level setting requested by the train operator. When this wire is energized, the engines of all trailing locomotives are caused to operate at a specific throttle value. In another example, when one locomotive experiences a fault condition, another of the wires is energized to alert the other locomotives of the condition's existence.

In some consists, locomotives communicate via their respective computer systems on an Ethernet network formed over the MU cables, or other intra-consist electrical cables. With this configuration, network data can be transmitted from the computer system in the lead locomotive to the computer systems in the trail locomotives, and vice-versa. The network data includes data that is packaged as data packets and uniquely addressed to particular computer systems, or portions of the computer systems. The network data can be, for example, vehicle sensor data indicative of vehicle health, commodity condition data, temperature data, weight data, and security data. The network data is transmitted orthogonal to conventional non-network (i.e., command) data that is already being transmitted on the MU cable.

Traditionally, communication over a MU cable or other intra-locomotive cable was limited to voltage levels for individual wires within the MU cable. For example, a high voltage applied to an individual wire might indicate one value, while a low or zero voltage applied to the individual wire might indicate a second value. While MU cables provide an existing infrastructure that can be used by the computer systems of locomotives to communicate network data, MU cables were not designed for network data communication.

For example, the wires within a MU cable are not shielded or twisted and are subject to interference. As a result, signal strength can degrade significantly as the signal propagates the length of a MU cable. For example, in a locomotive consist, the locomotive computer system adjacent to the signal's origin might receive the signal at 10 dBm, a locomotive further away in the consist might receive the signal at −30 dBm, which may be too weak to effectively transmit network data.

The signal degradation can be overcome by increasing strength of the signal when it is transmitted. While increasing the transmit signal allows for adequate signal strength to reach locomotive computer systems far away from the origin of the signal, it can overload the components of locomotive computer systems that are located close to the origin of the signal. For example, increasing the signal strength might produce a received 10 dBm signal at a locomotive further away from the origin of the signal, but might overload a locomotive computer system close to the origin of the signal with a 20 dBm signal.

Thus, one solution for overcoming signal degradation is to increase the strength of the transmit signal, but attenuate the signal on the receive end so as to not overload computer systems receiving the signal. Such a solution is described in U.S. Patent Publication No. 2012/0163201 (the '201 publication) filed by Williams et al. and published on Jun. 28, 2012. The '201 publication describes a cable modern auto-attenuation system capable of taking a high-power signal from the cable plant's service line, dropping the power value down to a usable level, and transmitting the signal to a cable modem. Although the system of the '201 publication may minimally solve the problem of overcoming signal degradation over cable, it may be less than ideal. In particular, the system would not be adequate for a trainline communications systems because it is not adapted to interface with trainline communication hardware. In addition, the system relies on hardware that can sense a signal level of transmitted signals, which may unnecessarily complicate the system.

The disclosed system is directed to overcoming one or more of the problems set forth above.

SUMMARY

In one aspect, the present disclosure is directed to a receive attenuation system for a locomotive consist having a communication network. The system may include a trainline communication processor and an adjustable attenuator. The adjustable attenuator may be configured to be connected to the network and variably attenuate a signal received via the network before transmitting the signal to the trainline communication processor. The system may also include a gain controller coupled to the adjustable attenuator. The gain controller may be configured to identify a transmitting locomotive from which the signal was sent, determine a tuned attenuation control value based on a distance between the transmitting locomotive and a receiving locomotive, and control the adjustable attenuator according to the tuned attenuation control value.

In another aspect, the present disclosure is directed to a computer-implemented method of adjusting receive attenuation in a locomotive consist having a communication network. The method may include identifying, by a controller, a transmitting locomotive from which a signal was sent. The method may also include determining, by the controller, a tuned attenuation control value based on a distance between the transmitting locomotive and a receiving locomotive. The method may additionally include controlling an adjustable attenuator according to the tuned attenuation control value.

The adjustable attenuator may be connected to a network and configured to variably attenuate signals received from the network before transmitting the signals to a trainline communication processor.

DETAILED DESCRIPTION

Figure 1:
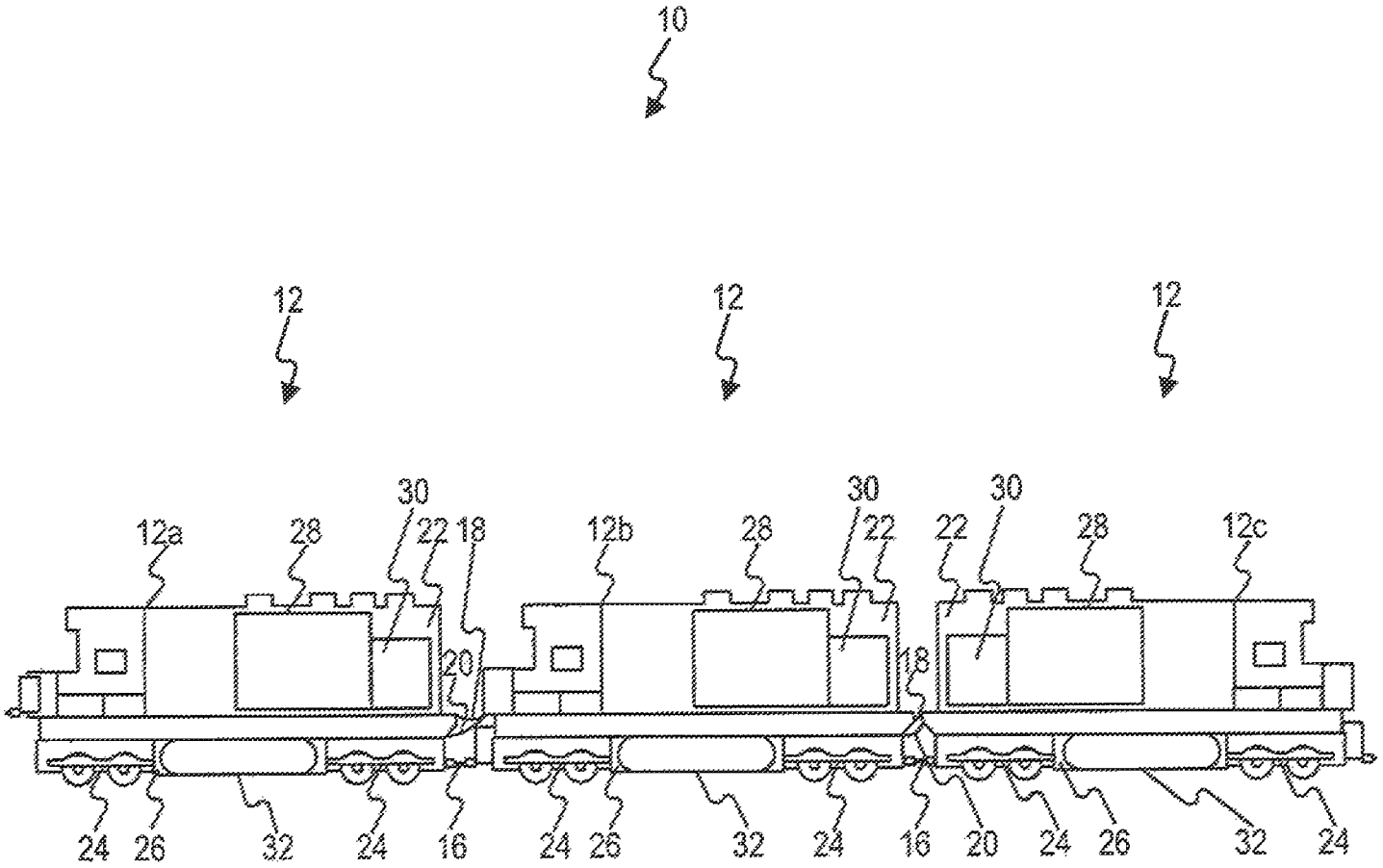
FIG. 1 is a pictorial illustration of an exemplary disclosed consist.

FIG. 1 illustrates an exemplary train consist 10 having one or more locomotives 12. In the disclosed embodiment, consist 10 has three different locomotives 12, including a lead locomotive 12*a* and two trailing locomotives 12*b*, 12*c*. It is contemplated, however, that consist 10 can include any number of locomotives 12 and other cars (e.g. tender cars), and that locomotives 12 can be located in any arrangement and in any orientation (e.g., forward-facing or rear-facing). Consist 10 can be located at the front of a train of other rail vehicles (not shown), within the train of rail vehicles, or at the end of the train of rail vehicles. It is also contemplated that more than one consist 10 can be included within a single train of rail vehicles, if desired, and/or that consist 10 can travel at times without a train of other rail vehicles.

Each locomotive 12 can be connected to an adjacent locomotive 12 in several different ways. For example, locomotives 12 can be connected to each other via a mechanical coupling 16, one or more fluid couplings 18, and one or more electrical couplings 20. Mechanical coupling 16 can be configured to transmit tractive and braking forces between locomotives 12. Fluid couplings 18 may be configured to transmit fluids (e.g., fuel, coolant, lubrication, pressurized air, etc.) between locomotives 12. Electrical couplings 20 can be configured to transmit power and/or data (e.g., data in the form of electrical signals) between locomotives 12. In one example, electrical couplings 20 include an intra-consist electrical cable, such as a MU cable, configured to transmit conventional command signals and/or electrical power. In another example, electrical couplings 20 include a dedicated data link configured to transmit packets of data (e.g., Ethernet data). In yet another example, the data packets can be transmitted via the intra-consist electrical cable. It is also contemplated that some data can be transmitted between locomotives 12 via a combination of the intra-consist electrical cable, the dedicated data link, and/or other means (e.g., wirelessly), if desired.

Each locomotive 12 can include a car body 22 supported at opposing ends by a plurality of trucks 24 (e.g., two trucks 24). Each truck 24 can be configured to engage a track (not shown) via a plurality of wheels, and to support a frame 26 of car body 22. Any number of engines 28 can be mounted to frame 26 within car body 22 and drivingly connected to a generator 30 to produce electricity that propels the wheels of each truck 24. Engines 28 can be internal combustion engines configured to combust a mixture of air and fuel. The fuel can include a liquid fuel (e.g., diesel) provided to engines 28 from a tank 32 located onboard each locomotive 12 or via fluid couplings 18, and/or a blended mixture of the liquid and gaseous fuels.

Figure 2:
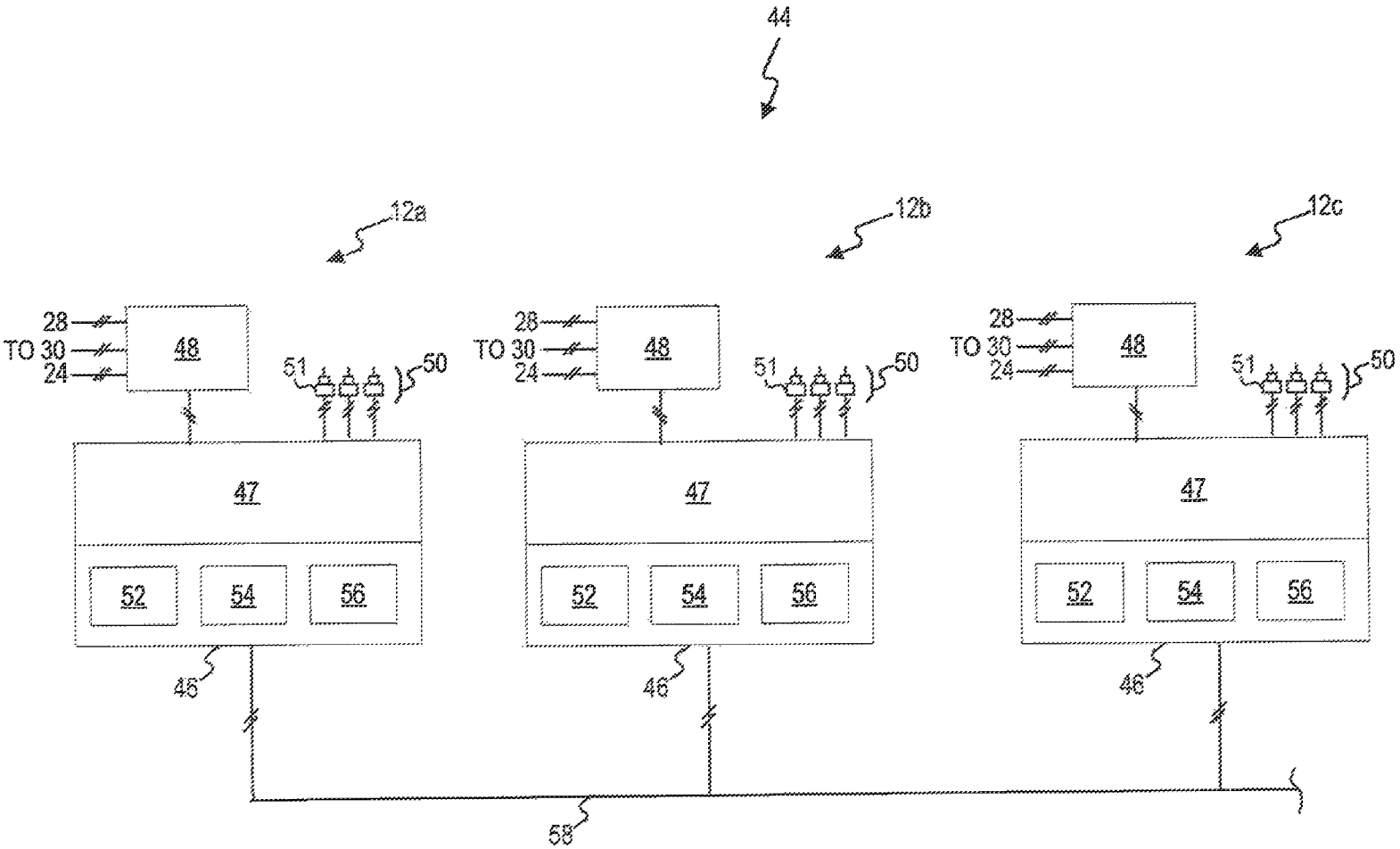
FIG. 2 is a diagrammatic illustration of an exemplary disclosed communication system that may be used in conjunction with the consist of FIG. 1.

As shown in FIG. 2, consist 10 can be equipped with a communication system 44 that facilitates coordinated control of locomotives 12. Communication system 44 can include, among other things, an access point 46 for each locomotive 12. Each access point 46 can be connected to one or more wired and/or wireless networks, and used to communicate command signals and/or data between controllers 48 and various other network components 50. Network components 50 may include various components configured to control locomotives 12, such as sensors, valves, pumps, heat exchangers, accumulators, regulators, actuators, etc. In an exemplary embodiment, network components 50 may each include a location device 51. Location device 51 may be a device configured to determine a current location (e.g., latitude/longitude coordinates) of a corresponding locomotive 12, such as a OPS device. Location device 51 may be configured to determine a current location of the corresponding locomotive 12 and transmit a location signal including the current location to controller 48 via access point 46.

Access points 46 can be connected to each other via electrical couplings 20 (e.g., via the intra-consist electrical cable, via the dedicated data link, and/or wirelessly). Access points 46 can be connected to a local area network hub ("LAN hub") 47 that facilitates communication between the controllers 48, the network components 50, and access points 46.

Each access point 46 can include an inter-consist router ("IC router") 52, an Ethernet bridge 54, and an MU modem 56, as well as conventional computing components known in the art (not shown) such as a processor, input/output (I/O) ports, a storage, a memory. The I/O ports may facilitate communication between the associated access point 46 and the LAN hub 47. In some embodiments, the I/O ports may facilitate communication between the associated access point 46 and one or more of network components 50.

Likewise, IC router 52 can facilitate communication between different access points 46 of locomotives 12 that are connected to each other via electrical couplings 20. In some embodiments, IC router 52 can provide a proxy IP address corresponding to controllers 48 and network components 50 of remote locomotives. For example, IC router 52 can provide a proxy IP address for one of network components 50 of locomotive 12*b* so controller 48 of locomotive 12*a* can communicate with it. The IC router 52 can include, or be connected to, an Ethernet bridge 54 that can be configured to translate network data to an electrical signal capable of being sent through intra-consist electrical cable 58. Ethernet bridge 54 can include or be connected to MU modem 56. MU modem 56 can be configured to modulate a carrier signal sent over intra-consist electrical cable 58 with the electrical signal received from Ethernet bridge 54 to transmit network data between access points 46. MU modem 56 can also be configured to demodulate signals received from access points 46 and send the demodulated signals to Ethernet bridge 54 for conversion to network data destined to controller 48 or network components 50. In some embodiments, MU modem 56 sends network data orthogonal to data traditionally transmitted over intra-consist electrical cable 58 (e.g., control data). Although FIG. 2 illustrates IC router 52, Ethernet bridge 54, and MU modem 56 as separate components, in some embodiments, one component can perform the functionality of two components. For example, Ethernet bridge 54 may perform the operations described above with respect to IC router 52, or Ethernet bridge 54 can include, or perform the operations of, MU modem 56.

While intra-consist electrical cable 58 is depicted and described herein, it should be understood that any type of network may be implemented to connect access points 46 of respective locomotives 12. For example, a wireless network may be additionally or alternatively implemented to connect one or more access points 46. Access points 46 may include additional or alternative components configured to communicate with the wireless network, such as radio and/or antenna components.

In some embodiments, access point 46, IC router 52, Ethernet bridge 54, and/or MU modem 56 can include a processor, storage, and/or memory (not shown). The processor can include one or more processing devices, such as microprocessors and/or embedded controllers. The storage can include volatile or non-volatile, magnetic, semiconductor, tape, optical, removable, non-removable, or other type of computer-readable medium or computer-readable storage device. The storage can be configured to store programs and/or other information that can be used to implement one or more of the processes discussed below. The memory can include one or more storage devices configured to store information.

Each controller 48 can be configured to control operational aspects of its related rail vehicle. For example, controller 48 of lead locomotive 12*a* can be configured to control operational aspects of its corresponding engine 28, generator 30, traction motors, operator displays, and other associated components. Likewise, the controllers 48 of trail locomotives 12*b* and 12*c* can be configured to control operational aspects of their corresponding engines 28, generators 30, traction motors, operator displays, and other associated components. In some embodiments, controller 48 of lead locomotive can be further configured to control operational aspects of trail locomotives 12*b* and 12*c*, if desired. For example, controller 48 of lead locomotive 12*a* can send commands through its access point 46 to the access points of trail locomotives 12*b* and 12*c*.

Each controller 48 can embody a single microprocessor or multiple microprocessors that include a means for controlling an operation of the associated rail vehicle based on information obtained from any number of network components 50 and/or communications received via access points 46. Numerous commercially available microprocessors can be configured to perform the functions of controller 48. Controller 48 can include a memory, a secondary storage device, a processor, and any other components for running an application. Various other circuits may be associated with controller 48 such as power supply circuitry, signal conditioning circuitry, solenoid driver circuitry, and other types of circuitry.

The information obtained by a particular controller 48 via access points 46 and/or network components 50 can include performance related data associated with operations of each locomotive 12 ("operational information"). For example, the operational information can include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art. In an exemplary embodiment, controller 48 may be configured to selectively obtain location information from location device 51. For example, location device 51 may regularly transmit location signals to controller 48 according to predetermined intervals, may transmit a location signal upon receipt of a request from controller 48 and/or other component of communication system 44, and/or may transmit a location signal based on receipt of an operator request.

The information obtained by a particular controller 48 via access points 46 and/or network components 50 may also include identification data of the other rail vehicles within the same consist 10. For example, each controller 48 may include stored in its memory the identification of the particular rail vehicle with which controller 48 is associated. The identification data may include, among other things, a type of rail vehicle (e.g., make, model, and unique identification number), physical attributes of the associated rail vehicle (e.g., size, load limit, volume, power output, power requirements, fuel consumption rate, fuel supply capacity, etc.), and maintenance information (e.g., maintenance history, time until next scheduled maintenance, usage history, etc.).

In an exemplary embodiment, the identification data may also include relative distance information, such as a distance between each locomotive. The distance between each locomotive may be determined, for example, by controller 48 based on location signals received from location device 51. For example, one or more controllers 48 may receive a location of each locomotive 12 (e.g., latitude/longitude coordinates) and execute one or more programs to calculate the distance between the two locations. In some embodiments, controller 48 may be configured to calculate and store a distance between an associated locomotive 12 (e.g., 12*a*) and each other locomotive 12 (e.g., 12*b* and 12*c*). The distance may include a current distance between locomotives 12 and/or an average distance between locomotives 12 over a predetermined period of time (e.g., a running average based on recently received location determination signals).

In other embodiments, distance information may be obtained based on other information. For example, a distance between locomotives 12 may be estimated based on a number of cars between the locomotives 12, which may be automatically determined based on known conditions of consist 10 and/or obtained from operator input. In another example, distance may be determined based on various signals sent through communication system 44. For example, if a first locomotive 12 communicates with a piece of offboard communication equipment (e.g., wayside station) and a second locomotive 12 communicates with a second piece of offboard communication equipment (e.g., wayside equipment) at approximately the same time, a distance between the first and second locomotives may be estimated based on a distance between the respective offboard communication equipment, which may be predetermined. Further, it should be understood that other methods for determining and/or estimating a distance between two locomotives may be used.

When coupled with other rail vehicles within a particular consist 10, each controller 48 can be configured to communicate the identification data (e.g., distance information) to the other controllers 48 within the same consist 10. Each controller 48, can be configured to selectively affect operation of its own rail vehicle based on the obtained identification data associated with the other rail vehicles of consist 10. Similarly, each controller 48 may be configured to selectively control communication between locomotives 12 based on obtained identification data.

In some embodiments, controllers 48 can be configured to affect operation of their associated rail vehicles based on the information obtained via access points 46 and/or network components 50 and one or more maps stored in memory. Each of these maps may include a collection of data in the form of tables, graphs, and/or equations. Controllers 48 can be configured to affect operation of their associated locomotives based on the position within a locomotive consist. The position of the locomotive associated with controller 48 can be used with the one or more maps to control the operation of the locomotive. For example, a map of throttle settings can be stored in the memory of controller 48. The map of throttle settings can include a mapping of consist position to throttle setting. For example, when the locomotive of controller 48 is the lead locomotive (e.g., in first position in the consist) the map may indicate that controller 48 should set the throttle to Notch 4, and when the locomotive of controller 48 is the third trailing locomotive (e.g., in fourth position in the consist), the map may indicate that controller 48 should set the throttle to Notch 2.

According to some embodiments, access point 46 can include one or more components for adjusting the attenuation of signals received on intra-consist electrical cable 58 (or other network). Attenuation of signals received on intra-consist electrical cable 58 can be important to increase signal strength throughout communication system 44. For example, controller 48 of lead locomotive 12*a* may transmit a signal over intra-consist electrical cable 58 communicating network data. When the signal reaches access point 46 of locomotive 12*b*, it may be sufficiently strong to communicate the network data, but when the signal reaches access point 46 of locomotive 12*c* (which is further away), the signal may have degraded to an unacceptable level. To ensure that access point 46 of locomotive 12*c* receives sufficient signal strength, access port 46 of locomotive 12*a* can increase the signal strength of transmissions. In some embodiments, the increase in signal strength is global to all transmissions originating from access port 46 of locomotive 12*a*. As a result, while access point 46 of locomotive 12*c* receives a signal of sufficient strength, access port 46 of locomotive 12*b* receives a signal that is too strong, potentially degrading the signal's integrity and data throughout performance, resulting in reduced bandwidth or, in some cases, complete interruption of communication. By configuring the access points 46 of consist 10 to attenuate receive signals, access point 46 of locomotive 12*a* can send signals via intra-consist electrical cable 58 at a high signal level to accommodate access point 46 of locomotive 12*c*, while not overloading access point 46 of locomotive 12*b* because access point 46 of locomotive 12*b* can attenuate the signal before it reaches components that clip, distort, and degrade signals of high strength.

Figure 3:
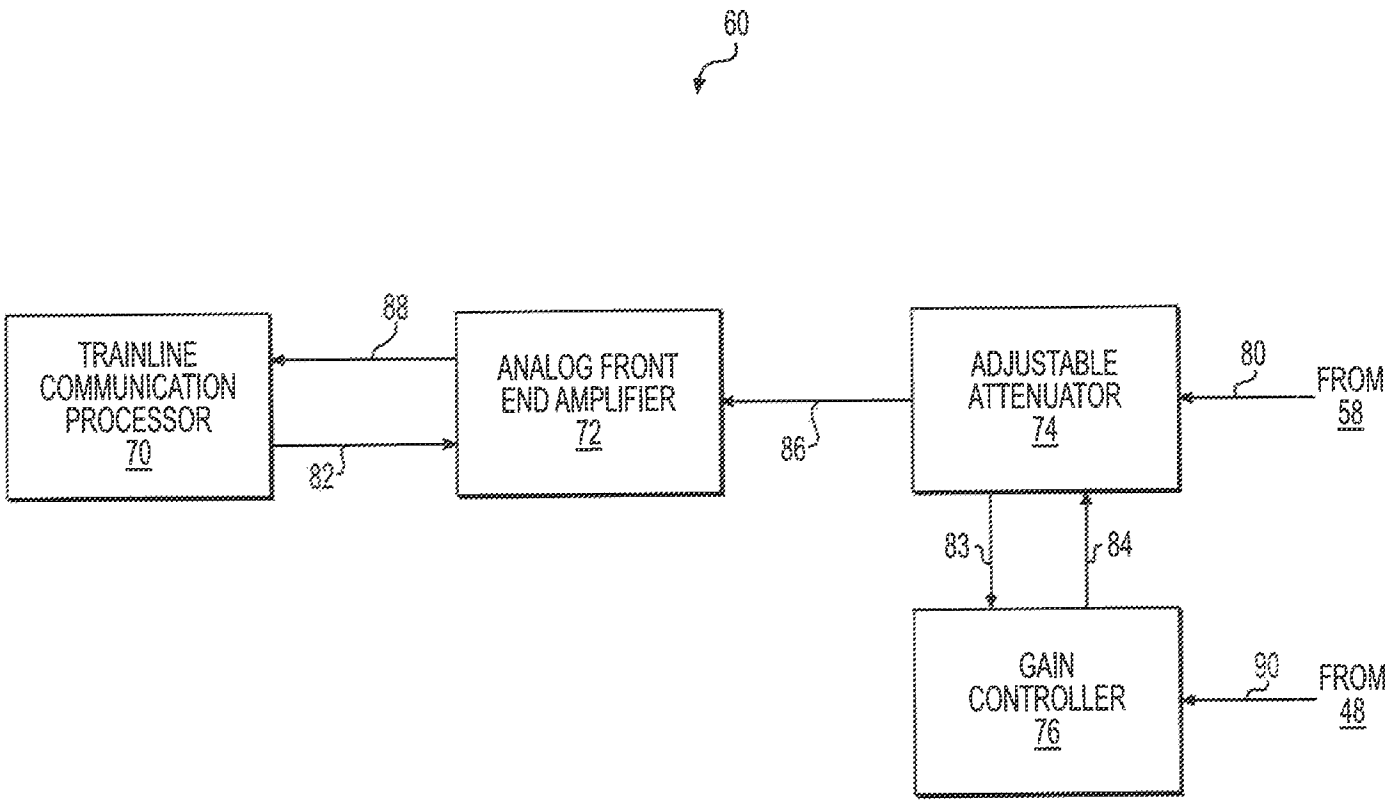
FIG. 3 is a diagrammatic illustration of an exemplary system for receive attenuation for use with the communication system of FIG. 2.

FIG. 3 is an illustration of an exemplary receive attenuation system 60 for use within communication system 44. According to some embodiments, receive attenuation system 60 operates to attenuate signals received by access point 46. Receive attenuation system 60 can include several components such as trainline communication processor 70, analog front end amplifier 72, adjustable attenuator 74, and gain controller 76. The components of receive attenuation system 60 can be connected by one or more signal paths that are configured to transmit digital or analog signals between the components of receive attenuation system 60. For example, receive attenuation system 60 can include MU receive signal path 80, receive gain control signal path 82, gain controller attenuation signal path 83, tuned gain control signal path 84, attenuated receive signal path 86, processor receive signal path 88, and gain controller receive signal path 90. Receive attenuation system 60 can be disposed in, or be part of, access point 46 or one of the components of access point 46. For example, trainline communication processor 70 can be included in Ethernet bridge 54, or it can be a processor that is part of access point 46. In some embodiments, access point 46 can include a motherboard with one or more expansion slots for accepting daughtercards to enhance the functionality of access point 46, and the operation of one or more components of receive attenuation system 60 can be embodied on a daughtercard. For example, gain controller 76 and adjustable attenuator 74 can be embodied as daughtercards.

Trainline communication processor 70 can perform operations to enable access point 46 to perform network communications over intra-consist electrical cable 58. Trainline communication processor 70 can receive incoming signals via processor receive signal path 88. The incoming signals can include a modulated signal containing network data to be processed by trainline communication processor 70, or some other component of access point 46. Conventionally, analog front end amplifier 72 receives incoming signals on MU receive signal path 80 and amplifies or attenuates these signals before they are sent to trainline communication processor 70 on processor receive signal path 88. Trainline communication processor 70 can control the amplification or attenuation analog front end amplifier 72 provides by sending signals to it via receive gain control signal path 82. For example, when trainline communication processor 70 receives a signal on processor receive path 88 that is too strong, it can send a signal on receive gain control signal path 82 to request that analog front end amplifier 72 attenuate the signal on processor receive path 88. By way of further example, when trainline communication processor 70 receives a signal on processor receive path 88 that is too weak, it can send a signal on receive gain control signal path 82 to request that analog front end amplifier 72 amplify the signal on processor receive path 88.

In some conventional embodiments, while analog front end amplifier 72 can provide some attenuation of the signals received on processor receive path 88, the attenuation may not be sufficient in some consist communication systems. For example, in consists with a large number of locomotives, signal strength needs to be very high so that signals can traverse intra-consist electrical cables and still be of sufficient strength at either end of the consist. A conventional analog front end amplifier may not provide sufficient attenuation to accommodate the strength of the signal for access points of locomotives that are adjacent or close to each other within the consist. Also, in some conventional embodiments, analog front end amplifier 72 can be embodied within the same component as trainline communication processor 70 (e.g., Ethernet bridge 54), can be difficult or expensive to replace, or perform functions with legacy hardware that may make analog front end amplifier 72 impractical to replace.

Receive attenuation system 60 overcomes these problems of conventional embodiments by further including adjustable attenuator 74. As shown in FIG. 3, adjustable attenuator 74 can be inserted between the analog front end amplifier 72 and intra-consist electrical cable 58. In some embodiments, however, adjustable attenuator 74 may replace analog front end amplifier 72. Adjustable attenuator 74 may be configured to receive incoming signals on MU receive signal path 80, attenuate the incoming signals, and send the attenuated incoming signals to analog front end amplifier 72 (and/or trainline communication processer 70), thereby providing attenuation for incoming signals.

Adjustable attenuator 74 can include circuitry that is capable of variably attenuating a signal before transmitting the signal to trainline communication processor 70. In some embodiments, adjustable attenuator 74 includes inputs allowing for external control. Adjustable attenuator 74 can be controlled digitally (e.g., by receiving a bit stream of data corresponding to the attenuation level to apply), and/or it can be controlled with an analog signal (e.g., a voltage or current corresponding to the attenuation level to apply).

In some embodiments, adjustable attenuator 74 can be controlled by gain controller 76. Gain controller 76 may be connected between controller 48 and adjustable attenuator 74. Gain controller 76 may be configured to receive an identification signal from adjustable attenuator 74 based on the received incoming signal through gain controller attenuation signal path 83. Gain controller 76 may analyze the identification signal to determine the source of the incoming signal. For example, gain controller 76 may determine, based on the identification signal, the transmitting locomotive 12 from which the incoming signal was sent.

In addition, gain controller 76 may communicate with controller 48 to receive identification data related to one or more locomotives 12 through gain controller receive signal path 90. For example, gain controller 76 may communicate with controller 48 to determine a distance between the locomotive 12 that sent the incoming signal ("transmitting locomotive") and the locomotive 12 which received the incoming signal ("receiving locomotive"), which may be the locomotive 12 on which gain controller 76 resides.

As described above, controller 48 may communicate with location device 51 to determine and store identification data that includes a determined and/or estimated distance between locomotives, such as the locomotive 12 on which controller 48 resides (e.g., locomotive 12*a*) and each other locomotive 12 (e.g., locomotives 12*b* and 12*c*). In some embodiments, gain controller 76 may communicate with controller 48 to access stored identification data. In other embodiments, gain controller 76 may transmit a signal to controller 48 requesting that controller 48 determine a current distance between the transmitting locomotive and the receiving locomotive, which controller 48 may complete and then transmit the result to gain controller 76. In still other embodiments, gain controller 76 may communicate with controller 48 (and/or intra-consist electrical cable 58) to receive location information (e.g., latitude/longitude coordinates) associated with one or more of the transmitting locomotive and the receiving locomotive and determine the distance between the locomotives 12 based on the received location information (e.g., instead of controller 48 determining the distance).

Based on the determined distance between the transmitting locomotive and the receiving locomotive, gain controller 76 may determine a tuned attenuation control value. The tuned attenuation control value may be encoded in a signal that is sent over tuned attenuation control signal path 84 to adjustable attenuator 74. Adjustable attenuator 74 may use the tuned attenuation control signal to determine an attenuation amount to apply to the received incoming signal before transmitting the incoming signal to analog front end amplifier 72 and/or trainline communication processor 70. Further operations of gain controller 76 are described in greater detail below with respect to FIG. 4.

INDUSTRIAL APPLICABILITY

The disclosed receive attenuation system may be applicable to any consist that includes a plurality of rail cars, such as locomotives. The disclosed receive attenuation system may provide tuned attenuation control based on a distance between a locomotive that transmits a signal and a locomotive that receives the signal. In this way, the disclosed receive attenuation system may take advantage of the nature of signals to degrade as they travel across longer distances, and allow for adjustment to a wider dynamic range of signal strengths, optimizing performance between closely-spaced locomotives and distant locomotives. The operation of the receive attenuation system will now be explained.

Figure 4:
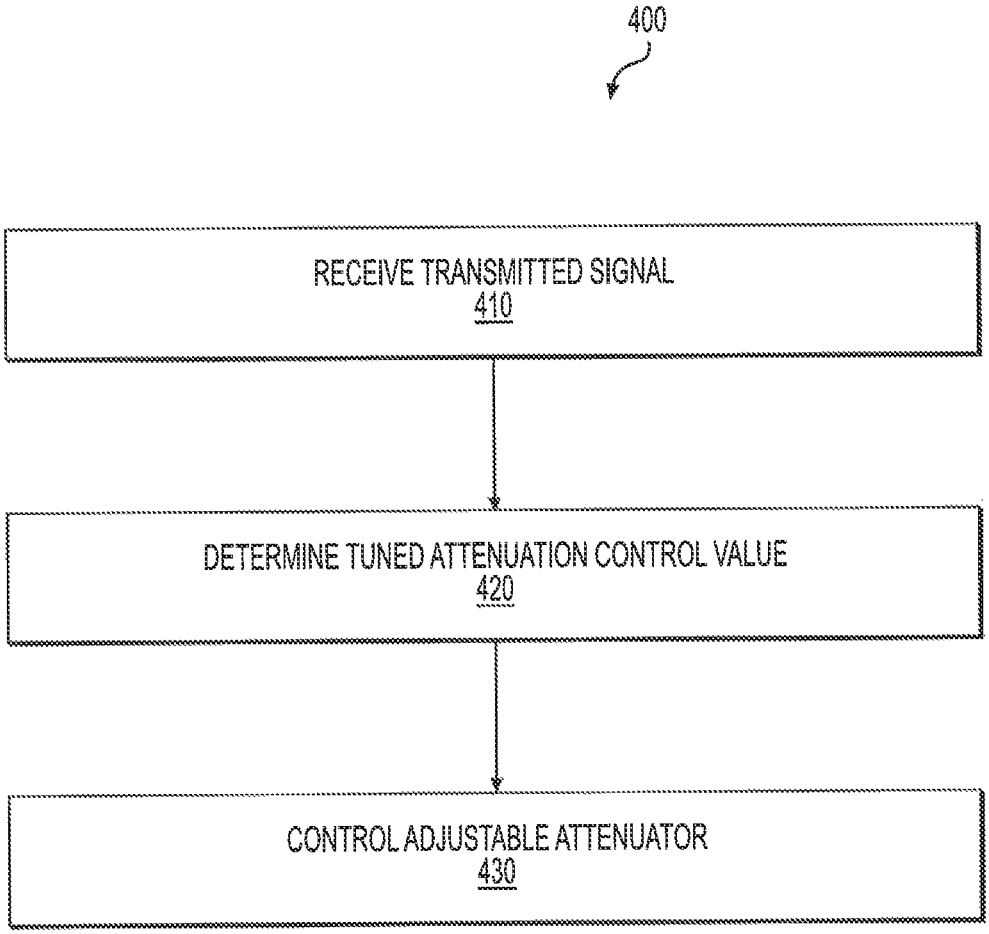
FIG. 4 is a flow chart illustrating an exemplary disclosed method for controlling receive attenuation that can be performed by one or more of the components of FIG. 3.

FIG. 4 is a flowchart illustrating an exemplary disclosed method for setting receive attenuation that can be performed by one of the components illustrated in FIG. 3. During the operation of consist 10, gain controller 76 may perform method 400 to adjust receive attenuation using adjustable attenuator 74. Although the description that follows describes method 400 as being performed by gain controller 76, other components of access point 46 can perform one or more of the steps of method 400 in some embodiments.

A transmitting locomotive may transmit a signal to a receiving locomotive. One or more components of the receive attenuation system 60 of the receiving locomotive may receive the transmitted signal (step 410). For example, adjustable attenuator 74 and/or gain controller 76 may receive a transmitted signal from intra-consist electrical cable 58 (or other network).

In an exemplary embodiment, gain controller 76 may thereafter identify the transmitting locomotive from which the signal was sent. As described above, gain controller 76 may be connected to adjustable attenuator 74 to receive a signal over gain controller attenuation signal path 83 indicating that an incoming signal was received. The signal may be an identification signal that gain controller 76 may process to determine a locomotive 12 that transmitted the signal, such as based on data encoded in the incoming signal (e.g., a IP address). Gain controller 76 may identify the locomotive 12 that transmitted the signal as the transmitting locomotive. In some embodiments, gain controller 76 may also identify the receiving locomotive. For example, gain controller 76 may identify the locomotive 12 on which trainline communication processor 70 (and/or another component of receive attenuation system 60) resides as the receiving locomotive. In other embodiments, gain controller 76 may not identify the transmitting and/or receiving locomotive.

Based at least on the identified transmitting locomotive, gain controller 76 may determine a tuned attenuation control value (step 420). According to some embodiments, the tuned attenuation control value may be determined based on a distance between the transmitting locomotive and the receiving locomotive. As described above, this distance may be determined by one or more of gain controller 76 and controller 48 (or some other component), based on location information accumulated by a location device 51 associated with the receiving locomotive and a location device 51 associated with the transmitting locomotive, and/or other location information or distance estimate information (e.g., the number of cars between the respective locomotives 12). For example, gain controller 76 or controller 48 may use a distance algorithm to calculate a distance between latitude/longitude coordinates received from location devices 51. In another example, gain controller 48 may receive a running average distance calculated by controller 48. In some embodiments, gain controller 76 may determine the distance between the transmitting locomotive and the receiving locomotive based on a received signal strength.

Gain controller 76 may determine the tuned attenuation control value based on the determined distance between the transmitting locomotive and the receiving locomotive by using one or more determination processes, which may include attenuation algorithms, lookup tables, maps, configuration files, and/or the like. In an exemplary embodiment, tuned attenuation control values may be inversely proportional to the distance between the respective locomotives. For example, greater distances between locomotives 12 may correspond to lower attenuation control values (since less attenuation may be necessary when locomotives 12 are separated by a greater distance) and smaller distances between locomotives 12 may correspond to greater attenuation control values (since more attenuation may be necessary when locomotives 12 are close together). In one embodiment, gain controller 76 may compare the determined distance to a lookup table to identify a tuned attenuation control value that corresponds to the determined distance.

Gain controller 76 may thereafter control adjustable attenuator 74 based on the determined tuned attenuation control value (step 430). As described above, gain controller 76 may send the tuned control value using tuned gain control signal path 84. In this way, gain controller 76 controls adjustable attenuator 74 such that adjustable attenuator 74 attenuates signals received on MU receive signal path 80 before the signals are sent to analog front end amplifier 72 and/or trainline communication processor 70.

In an exemplary embodiment, gain controller 76 may control adjustable attenuator 74 to attenuate an incoming signal to a signal strength within a range that allows for efficient use of the signal by trainline communication processor 70. For example, gain controller 76 may control adjustable attenuator 74 to attenuate an incoming signal to a signal strength that is strong enough for effective use by trainline communication processor 70, but not too strong as to overload trainline communication processor 70.

In other embodiments, gain controller 76 may control adjustable attenuator 74 to attenuate an incoming signal to a signal strength within a first range, and allow analog front end amplifier 72 to further attenuate (or amplify) the signal to a signal strength within a second, narrower range within the first range. In this way, adjustable attenuator 74 and analog front end amplifier 72 may work in conjunction to finely tune the signal strength of incoming signals that are received by trainline communication processor 70.

Several advantages over the prior art may be associated with the disclosed receive attenuation system. For example, the disclosed receive attenuation system may base attenuation control on a distance between a locomotive that transmits a signal and a locomotive that receives the signal. In this way, the disclosed receive attenuation system can provide simpler and more effective attenuation control than what can be achieved using attenuators currently available in trainline communication analog front end amplifiers.

It will be apparent to those skilled in the art that various modifications and variations can be made to the receive attenuation system. Other embodiments will be apparent to those skilled in the art from consideration of the specification and practice of the disclosed receive attenuation system. It is intended that the specification and examples be considered as exemplary only, with a true scope being indicated by the following claims and their equivalents.

What is claimed is:

1. A receive attenuation system for a locomotive consist having a communication network, the system comprising:
- a trainline communication processor;
- an adjustable attenuator configured to be connected to the network and variably attenuate a signal received via the network before transmitting the signal to the trainline communication processor; and
- a gain controller coupled to the adjustable attenuator and configured to:
  - identify a transmitting locomotive from which the signal was sent,
  - determine a tuned attenuation control value based on a distance between the transmitting locomotive and a receiving locomotive, and
  - control the adjustable attenuator according to the tuned attenuation control value.

2. The receive attenuation system of claim 1, further comprising an analog front end amplifier coupled between the trainline communication processor and the adjustable attenuator and configured to further attenuate the signal transmitted from the adjustable attenuator.

3. The receive attenuation system of claim 1, wherein the gain controller is further configured to:
- transmit the identified transmitting locomotive to a controller, and
- receive the distance between the transmitting locomotive and the receiving locomotive from the controller.

4. The receive attenuation system of claim 1, wherein the gain controller is further configured to:
- identify the receiving locomotive, and
- determine the distance between the transmitting locomotive and the receiving locomotive.

5. The receive attenuation system of claim 4, wherein the gain controller is further configured to determine the distance between the transmitting locomotive and the receiving locomotive based on a location of the transmitting locomotive and a location of the receiving locomotive.

6. The receive attenuation system of claim 5, wherein the locations are determined by GPS devices positioned on the transmitting locomotive and the receiving locomotive.

7. The receive attenuation system of claim 1, wherein the gain controller is configured to estimate the distance between the transmitting locomotive and the receiving locomotive based on a number of cars between the transmitting locomotive and the receiving locomotive.

8. The receive attenuation system of claim 1, wherein the network includes an intra-consist electrical cable.

9. The receive attenuation system of claim 1, wherein the network includes a wireless network.

10. The receive attenuation system of claim 1, wherein the tuned attenuation control value is inversely proportional to the distance between the transmitting locomotive and the receiving locomotive.

11. A computer-implemented method for adjusting receive attenuation in a locomotive consist having a communication network, the method comprising:
- identifying, by a controller, a transmitting locomotive from which a signal was sent;
- determining, by the controller, a tuned attenuation control value based on a distance between the transmitting locomotive and a receiving locomotive; and
- controlling an adjustable attenuator according to the tuned attenuation control value, the adjustable attenuator connected to a network and configured to variably attenuate signals received from the network before transmitting the signals to a trainline communication processor.

12. The computer-implemented method of claim 11, further comprising:
- identifying, by the controller, the receiving locomotive, and
- determining, by the controller, the distance between the transmitting locomotive and the receiving locomotive.

13. The computer-implemented method of claim 12, further comprising receiving a location of the transmitting locomotive and the receiving locomotive, wherein the distance between the transmitting locomotive and the receiving locomotive is determined based on the received locations.

14. The computer-implemented method of claim 12, wherein the distance between the transmitting locomotive and the receiving locomotive is estimated based on a number of cars between the transmitting locomotive and the receiving locomotive.

15. The computer-implemented method of claim 11, wherein determining the tuned attenuation control value includes:

comparing, by the controller, the determined distance to a lookup table, and identifying a tuned attenuation control value that corresponds to the determined distance.

16. The computer-implemented method of claim 11, further comprising attenuating, by an analog front end amplifier, the signal transmitted from the adjustable attenuator.

17. The computer-implemented method of claim 16, further comprising:

attenuating, by the adjustable attenuator, the signal received by the adjustable attenuator to a signal strength within a first range, transmitting the signal from the adjustable attenuator to the analog front end amplifier, and attenuating, by the analog front end amplifier, the signal to a signal strength within a second range, narrower than and within the first range.

18. A locomotive consist, comprising:

a network;

a first locomotive having a first access point configured to transmit a signal via the network;

a second locomotive having a controller and a second access point configured to receive the signal via the network, the second access point including:

a trainline communication processor;

an adjustable attenuator connected to the network and configured to variably attenuate a signal received over the network before transmitting the signal to the trainline communication processor; and a gain controller coupled to the adjustable attenuator and the controller, the gain controller configured to:

identify the first locomotive, determine a tuned attenuation control value based on a distance between the first locomotive and the second locomotive, and control the adjustable attenuator according to the tuned attenuation control value.

19. The locomotive consist of claim 18, wherein:

the gain controller is further configured to transmit a signal identifying the first locomotive to the controller, and the controller is configured to identify the second locomotive and determine the distance between the first locomotive and the second locomotive.

20. The locomotive consist of claim 19, wherein:

the first locomotive further comprises a GPS device, the second locomotive further comprises a GPS device, the controller is further configured to determine the distance between the first locomotive and the second locomotive based on location information determined by the GPS devices.

* * * * *